US012668986B2

(12) United States Patent
Pilarczyk et al.

(10) Patent No.: US 12,668,986 B2
(45) Date of Patent: Jun. 30, 2026

(54) APPARATUS FOR SECURING POLE

(71) Applicant: WCM Industries, Inc., Colorado Springs, CO (US)

(72) Inventors: Eric Pilarczyk, Colorado Springs, CO (US); William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 215 days.

(21) Appl. No.: 18/454,583

(22) Filed: Aug. 23, 2023

(65) Prior Publication Data

US 2025/0067077 A1 Feb. 27, 2025

(51) Int. Cl.
*E04H 12/22* (2006.01)
*E04H 17/26* (2006.01)

(52) U.S. Cl.
CPC ..... *E04H 12/2269* (2013.01); *E04H 12/2215* (2013.01); *E04H 12/22* (2013.01); *E04H 12/2238* (2013.01); *E04H 12/2253* (2013.01); *E04H 17/263* (2013.01)

(58) Field of Classification Search
CPC ..... E04H 12/2269; E04H 12/2215; E04H 12/2253; E04H 12/22; E04H 12/2238; E04H 17/263
See application file for complete search history.

(56) References Cited

U.S. PATENT DOCUMENTS 5,752,349 A * 5/1998 Fitzsimmons ..... A63B 71/023 52/165
6,889,699 B2 5/2005 Clarke
7,293,573 B2 11/2007 Clarke
7,318,444 B2 1/2008 Clarke
7,543,415 B2 6/2009 Svendsen
7,600,734 B2 10/2009 Clarke
8,033,077 B2 10/2011 Svendsen
8,661,767 B2 3/2014 Svendsen
(Continued)

FOREIGN PATENT DOCUMENTS

FR 2747148 A1 * 10/1997 ..... E04H 12/2223

OTHER PUBLICATIONS

Hayward, Pro Series Filters, Folder Umbrella Lateral Holder Assembly, https://discountpoolmart.com/hayward-pro-series-filters-folding-umbrella-lateral-holder-assembly-sx242ma, retrieved on Sep. 28, 2023.

(Continued)

*Primary Examiner* — Omar F Hijaz

(57) ABSTRACT

A pole holder apparatus is provided. The apparatus may include a socket, an insert, and a cap. The insert may be configured to screw into the socket, and the cap may be configured to selectively cover an upper opening of the insert and remain coupled to the insert, even when in an open position. The insert may include a plurality of tabs configured to engage an inserted pole. In some examples, when the insert is screwed into the socket, tabs of the insert are deflected inward to hold an inserted pole in place. The insert may be screwed in a first amount to accommodate a pole having a first diameter, and it may be screwed in further to accommodate a pole having a second, lesser diameter. In other examples, an insert may include a friction-fit insert configured to adapt to a variety of sockets and pole sizes.

18 Claims, 14 Drawing Sheets

(56) References Cited

U.S. PATENT DOCUMENTS

| | | | | |
|---|---|---|---|---|
| 2004/0169121 | A1* | 9/2004 | Winn | A45B 1/00 248/156 |
| 2023/0003047 | A1* | 1/2023 | Hostert | A47B 37/04 |
| 2025/0067078 | A1* | 2/2025 | Schorr | E04H 12/2269 |

OTHER PUBLICATIONS

AquaStar Umbrella Stands specification sheet—www.aquastarpoolproducts.com retreived on Sep. 28, 2023.
SR Smith Pool Better Brochure, srsmith.com retreived on Sep. 28, 2023.
TUUCI installation guide, www.tuuci.com retreived on Sep. 28, 2023.

* cited by examiner

APPARATUS FOR SECURING POLE

BACKGROUND

The use of umbrellas as a means of protection from the sun or rain is a common practice in various settings, such as backyards, patios, beach fronts, outdoor cafes, and the like. To securely hold these umbrellas, especially in windy conditions or on uneven terrains, a stable and robust umbrella holder is useful.

It is with respect to this general technical environment that aspects of the present application are directed.

SUMMARY

In an aspect, the present applications relates to a pole socket, including: a socket body, including an open end and a closed end; an insert, including an upper opening and a lower opening, and configured to be secured to the socket body proximate to the open end of the socket body; and a cap, configured to be attached to the insert and remain attached to the insert in an open position, where the cap uncovers the upper opening, and in a closed position, where the cap covers the upper opening.

In some examples, an inner wall of the socket body includes a lower tapered section proximate to the closed end of the socket body. In some examples, the insert further includes a plurality of tabs proximate to the lower opening of the insert. In some examples, the plurality of tabs expand when the insert is unscrewed from the socket body. In some examples, the insert is discontinuous proximate to the lower opening of the insert. In some examples, the socket body is internally threaded, where the insert is externally threaded and configured to engage the internal threads of the socket body. In some examples, an inner wall of the socket body includes an upper tapered section proximate to the open end of the socket body. In some examples, the insert further includes a plurality of tabs proximate to the lower opening of the insert, and where the plurality of tabs are configured to deflect inwards when the insert is screwed into the socket body and when the plurality of tabs contact the upper tapered section. In some examples, the open end of the socket body, the upper opening of the insert, and the lower opening of the insert are configured to receive an umbrella pole. In some examples, the insert is configured to friction fit into the socket body. In some examples, the insert further includes a plurality of tabs angled inwards. In some examples, the insert further includes a plurality of openings corresponding to the plurality of tabs, where when a pole is placed in the insert, the plurality of tabs deflect outwards and at least partially through the plurality of openings.

In another aspect, the technology relates to a pole socket, including: a socket body including internal threading; an insert including external threading and a plurality of tabs, where the insert is configured to be screwed into the socket body through the engagement of the external threading with the internal threading, and where the plurality of tabs are configured to deflect inwards as the insert is screwed into the socket body; and a cap that is configured to cover an upper opening in the insert.

In some examples, an inner wall of the socket body includes a lower tapered section proximate to a closed end of the socket body. In some examples, the plurality of tabs expand when the insert is unscrewed from the socket body. In some examples, the insert is discontinuous proximate to a lower opening of the insert.

In another aspect, the technology relates to a pole socket, including: a socket body including internal threading; an insert including external threading and a plurality of tabs, where the insert is configured to be screwed into the socket body through the engagement of the external threading with the internal threading, and where the plurality of tabs are configured to deflect inwards as the insert is screwed into the socket body; and a cap, configured to be attached to the insert and remain attached to the insert in an open position, where the cap uncovers an upper opening, and in a closed position, where the cap covers the upper opening.

In some examples, an inner wall of the socket body includes a lower tapered section proximate to a closed end of the socket body. In some examples, the plurality of tabs expand when the insert is unscrewed from the socket body. In some examples, the insert is discontinuous proximate to a lower opening of the insert.

BRIEF DESCRIPTION OF THE DRAWINGS

There are shown in the drawings examples that are presently preferred, it being understood, however, that the invention is not limited to the precise arrangements and configurations shown.

DETAILED DESCRIPTION

Figure 1:
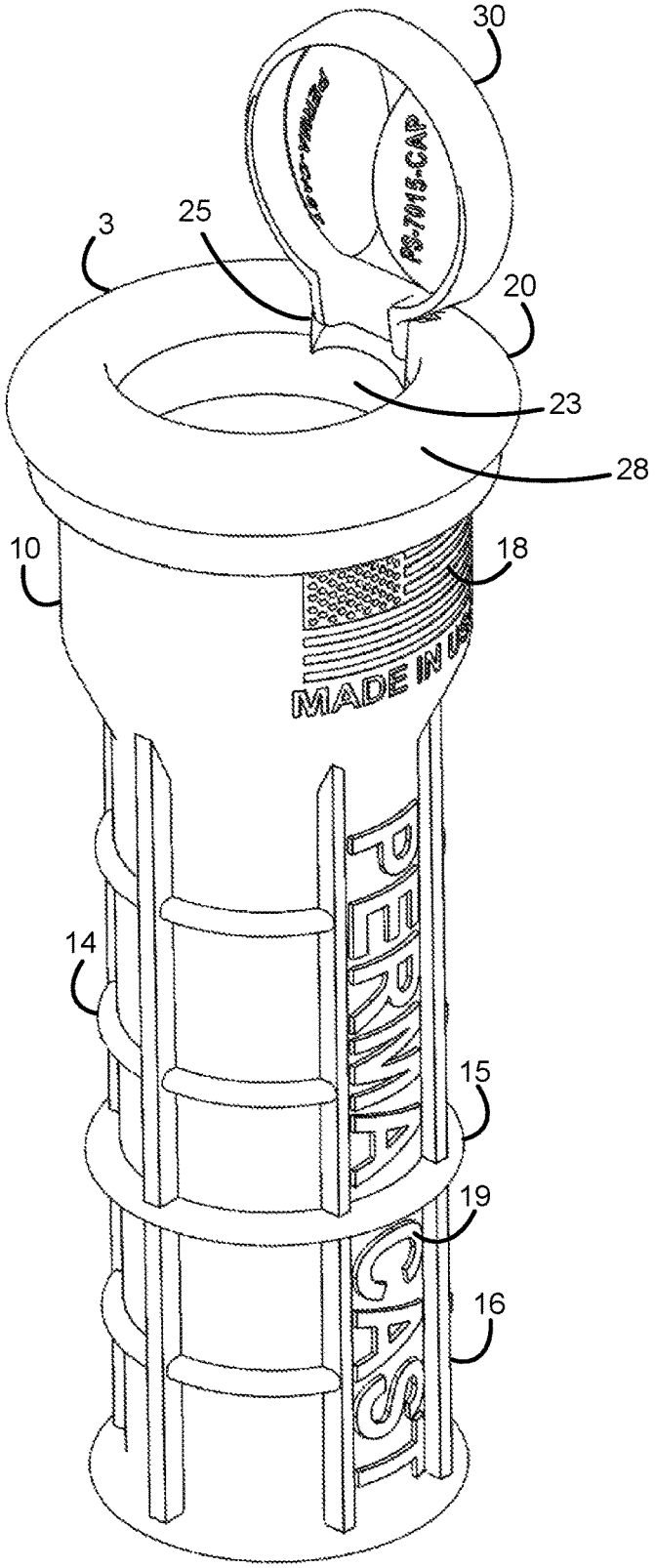
FIG. 1 is an assembly isometric view of a pole holder apparatus.
Figure 2:
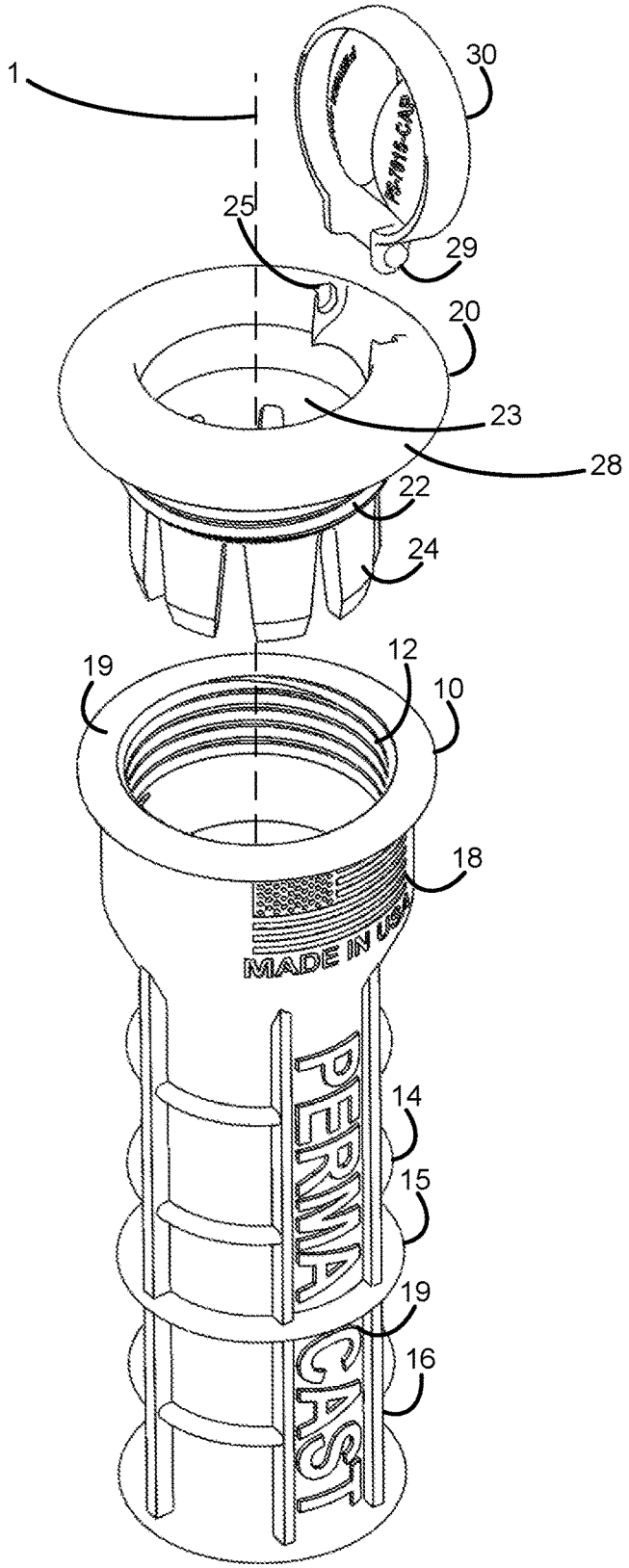
FIG. 2 is an exploded isometric view of the pole holder apparatus.
Figure 3:
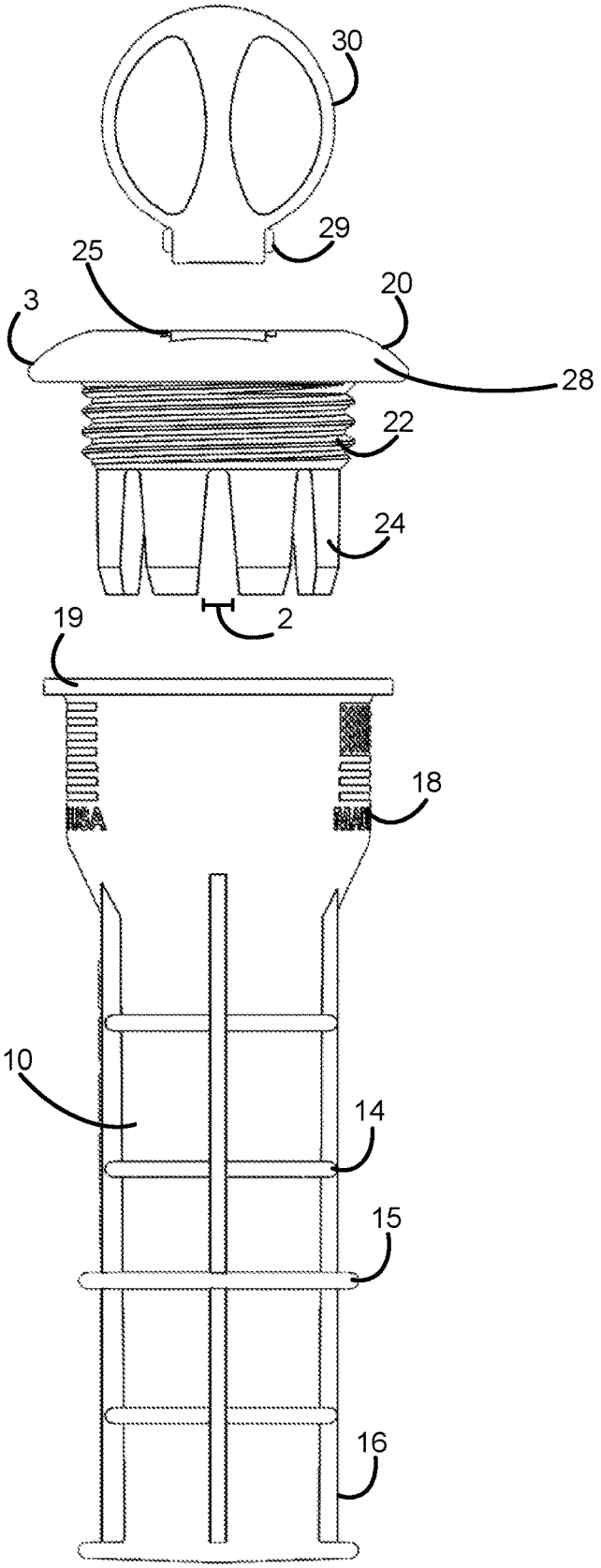
FIG. 3 is an exploded front view of the pole holder apparatus.
Figure 4:
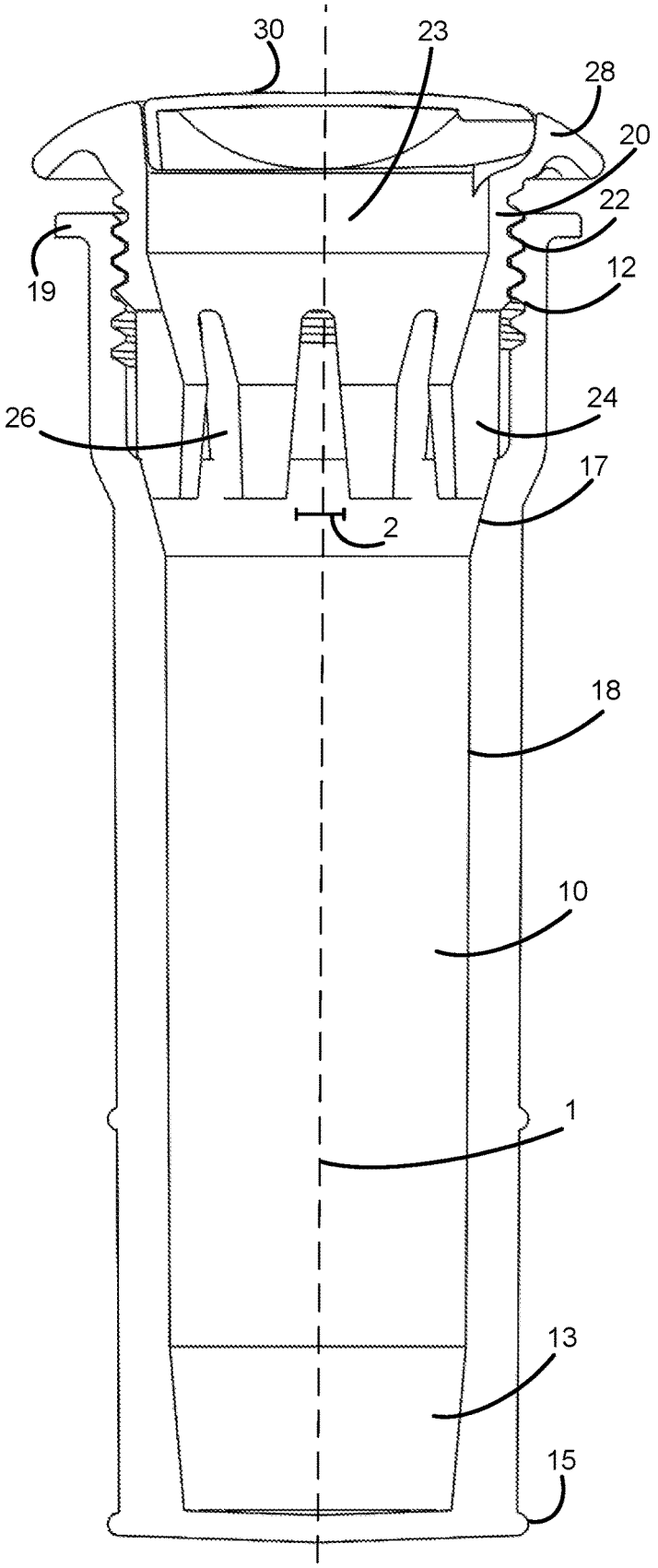
FIG. 4 is an assembly front section view of the pole holder apparatus.
Figure 5:
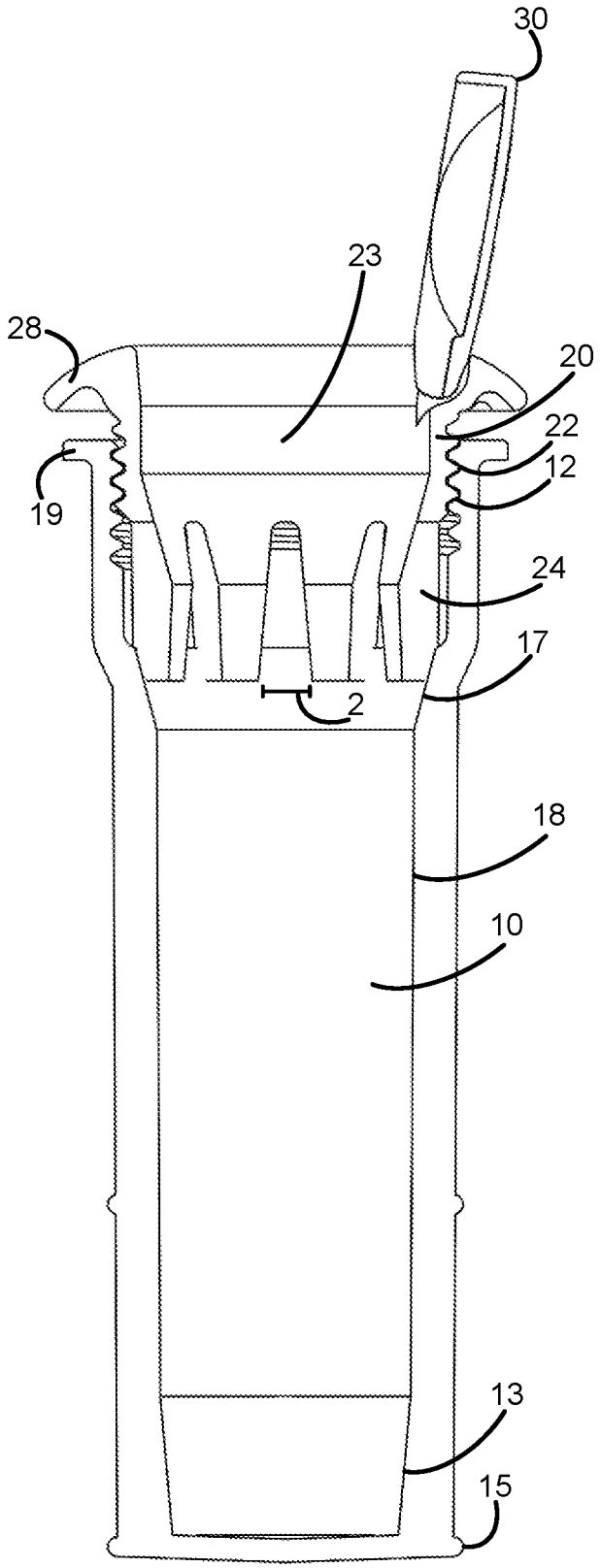
FIG. 5 is a similar assembly front section view to FIG. 4, but with a cap open.

FIG. 1 is an assembly isometric view of a pole holder apparatus according to an embodiment of the invention. FIG. 2 is an exploded isometric view of the pole holder apparatus. FIG. 3 is an exploded front view of the pole holder apparatus. FIG. 4 is an assembly front section view of the pole holder apparatus. FIG. 5 is a similar assembly front section view to FIG. 4, but with a cap open.

Referring concurrently to FIGS. 1-5, the apparatus (e.g., pole socket) may include a socket 10 (e.g., socket body), an insert 20, and a cap 30. These elements may be configured to provide a robust and secure installation for holding an umbrella pole, or any other pole or similar apparatus. The pole may be configured to be placed through the insert 20, inside the socket 10, when the cap 30 is up as shown. The socket 10, insert 20, and cap 30 may be made of any material or combinations of materials, such as metals, alloys, polymers (e.g., plastics), ceramics, glasses, composites, the like, or combinations thereof. Different parts of the socket 10, insert 20, and cap 30 may be made of the same material or different materials.

The socket 10 may be designed to be embedded into the ground, into wet cement, or into any other surface or material, providing the base and stability for the assembly and a pole, such as an umbrella pole. The socket 10 may include horizontal ridges 14, large horizontal ridges 15, vertical ridges 16, or combinations thereof. These ridges may provide structural stability to the socket 10 while saving on overall material needed. In addition, the ridges may provide additional surfaces to resist twisting or pulling out when the socket is installed (e.g., into cement of a pool deck). For example, the top and bottom surfaces of the horizontal ridges 14 may act as surfaces that exert a normal force on the surrounding concrete or other material that prevent or restrict the socket 10 from being pulled up or pushed further down into the concrete. The large horizontal ridges 15 may serve a similar purpose. Similarly, the side surfaces of the vertical ridges 16 may act as surfaces that exert a normal force on the concrete or other material that prevent or restrict the socket 10 from being rotated after installation. Additional or alternative horizontal ridges 14, large horizontal ridges 15, or vertical ridges 16 may be disposed over the outside of the socket 10 in different arrangements other than the arrangement shown.

Socket 10 may be in a generally cylindrical shape, though other shapes may be contemplated. In the example shown, an inner wall of the socket 10 includes a smallest internal diameter at the closed end of the socket 10. The inner wall of the socket 10 includes a lower tapered section 13, in which an internal diameter of the socket 10 increases in the direction of the open end of the socket 10. In the example shown, a middle section 18 of the inner wall of the socket 10 includes a substantially consistent internal diameter. In examples, the inner diameter of the middle section 18 of the inner wall is approximately equal to, or slightly smaller than, the inner diameter of the opening 23 in the cap 30. Further, an upper tapered section 17 of the inner wall tapers to a wider internal diameter proximate the open end of the socket to accommodate the insert 20, as further described below. In the example shown, a portion of the outer diameter of the socket 10 also tapers out to mimic the upper tapered section 17 of the inner surface of the socket 10; however, other configurations of the outer diameter are possible and contemplated. Socket 10 may include internal threads 12 for a corresponding engagement with the insert 20, which is shown in further detail in FIG. 2.

Insert 20 may be configured to be threadingly engaged with the socket 10 using external threads 22 that mate with the internal threads 12 of the socket 10, which is shown in further detail in FIG. 2. The insert 20 may include a flange 28 configured to cover an upper lip 19 of socket 10 when the insert 20 is fully inserted into socket 10. The insert 20 may be designed to accommodate the pole of an umbrella or other poles (such as to hold a net for a game, etc.). Insert 20 may be able to accommodate various pole sizes (e.g., diameters), such as pole diameters that are equal to or less than the diameter of the opening 23 and middle section 18.

Cap 30 may be designed to close off the assembly when it is not in use (e.g., when a pole is not in the assembly), preventing concrete, dirt, water, or other undesired elements from entering the socket 10 and insert 20. The cap 30 may be configured with one or more cap tabs 29 to snap into receiving snapping elements 25 of the insert 20. For example, once the cap tabs 29 are inserted into the receiving snapping elements 25, the cap 30 is able to be rotated about the cap tabs 29 within the receiving snapping elements 25 out of the way of the opening 23 without being disconnected from the insert 20. By designing the cap 30 to be snapped into the insert 20, the cap 30 may be able to stay attached to the apparatus during insertion of a pole, which may prevent a user from losing the cap 30. Alternative designs of affixing the cap 30 to the insert 20 may be contemplated. For example, the cap 30 may be configured to be fixed with a pin to insert 20 (not shown), or a press-release configuration may be implemented to release the cap 30 (not shown). In some other examples, cap 30 may be configured to be detached from the insert 20 when the insert is screwed into the socket or when a pole is inserted into the opening 23.

The socket 10, insert 20, and cap 30 provide a secure, efficient, and easy-to-use solution for supporting a pole. The apparatus allows the pole (e.g., an umbrella pole) to be held firmly in place, resistant to weather conditions, while still permitting easy removal and storage when necessary.

As discussed, FIG. 2 is an exploded isometric view of the pole holder apparatus according to an embodiment of the invention. FIG. 3. is an exploded front view of the pole holder apparatus according to an embodiment of the invention. Previous descriptions of the same or similar features will not be repeated for brevity.

Socket 10 may include internal threads 12 to threadingly engage with the external threads 22 of the insert 20 in a screwable fashion. The mating configuration of internal threads 12 and external threads 22 may each include a pitch, diameter, profile, and angle that may be configured in various ways. For instance, a fine-thread configuration may be used, or a coarse-thread configuration may be used (e.g., for ease of assembly or when threading into softer materials), or some other configuration. In some examples, internal threads 12 and external threads 22 may be tapered threads to form a pressure-tight seal. Male external threads 22 may engage with female internal threads 12, and as insert 20 is tightened, the threads may compress against each other, forming a seal. In the example disclosed, as the insert 20 is rotated in a clockwise direction, the internal threads 12 and external threads 22 cooperate to translate the rotational movement of the insert into downward movement of the insert (towards the closed end of the socket 10).

Insert 20 may include a plurality of tabs 24 configured to engage with poles of equal or lesser diameter than the opening 23 and maintain rigidity and support of the pole. The plurality of tabs 24 may be formed below the external threads 22 of the insert 20 and arranged in a substantially circular, discontinuous cross section about the bottom of the insert 20. The tabs 24 may be configured to fit inside the socket 10. The distal ends of tabs 24 may be configured to contact the upper tapered section 17 of the socket 10 to force the tabs 24 closer towards the longitudinal axis 1 of the socket 10 as the insert 20 is screwed into the socket 10. The tabs 24 may deflect inwards towards the longitudinal axis 1 of the socket 10 upon contacting the upper tapered section 17, and the spaces 2 between the tabs 24 may serve to provide space for such deflection. The spaces 2 between the tabs 24 may form a discontinuous lower opening of the insert 20. By deflecting inwards, tabs 24 may grip an inserted pole (such as an umbrella pole) of a diameter less than or equal to the diameter of the middle section 18 of the interior wall of the socket 10. In this way, a user may be able to selectively tighten the insert 20 into the socket 10 to adjust the force with which the overall apparatus grips an inserted pole. In addition, because the tabs 24 continue to deflect more inwardly along upper tapered section 17 as the insert is lowered (e.g., by screwing the insert 20 into the socket 10), poles of different diameters may be accommodated. For example, a pole that has a diameter almost as wide as the diameter of the middle section 18 of the interior wall of the socket 10 will be contacted by the deflecting tabs 24 relatively quickly as the insert 20 is screwed into the socket 10. In this instance, if the pole has been inserted through opening 23 into the socket 10, the tabs 24 may be fully tightened around the inserted pole before the insert 20 is fully screwed into the socket 10. By contrast, a pole of a smaller diameter may still be accommodated, as the distal ends of the tabs 24 will continue to deflect further towards to the longitudinal axis 1 of the socket 10 until the insert 20 is fully screwed into the socket 10. As such, the tabs 24 may be tightened around a smaller diameter pole by further screwing the insert 20 into the socket 10 until the tabs 24 are tightened around the pole. In some examples, the edge 3 of the insert 20 may be serrated for grip while twisting the insert 20 to tighten around a pole (not shown). Alternative inserts are also contemplated, for example, as described in later Figures.

To release a pole, the insert 20 may be rotated in reverse (e.g., counterclockwise if the threads 12 are configured so that the insert 20 is screwed into the socket 10 with a clockwise rotation), and as such, tabs 24 move upwards, and the distal ends of the tabs move away from the longitudinal axis 1 of the socket 10 and, e.g., eventually lose contact with the inserted pole. In examples, the tabs 24 are formed of a plastic (or other material) that substantially returns to an undeflected state when not being deflected towards the longitudinal axis 1 of the socket 10 by contact with the upper tapered section 17. The grip on a pole by tabs 24 may be significantly reduced or eliminated at this point, and the pole may be easily removed.

Although six tabs 24 are depicted, other numbers of tabs 24 are possible and contemplated.

FIG. 4 is a front cross-sectional view of the pole holder apparatus according to an embodiment of the invention. FIG. 5 is similar to FIG. 4, but with the cap 30 in an open position according to an example. Previous descriptions of the same or similar features will not be repeated for brevity.

In some cases, socket 10 may be partially submerged into concrete (such as a pool deck) or some other material, providing a stable base for the apparatus. The socket 10 may be cylindrical, with the mating of the internal threads 12 and external threads 22 visible in this section view. Further, tabs 24 are shown as in contact with upper tapered section 17 of the inner wall of the socket 10. Functionally, as the insert 20 is screwed in further, the tabs 24 would move downward, and the distal ends of the tabs 24 are forced to deflect inward by the tapering of upper tapered section 17. This inward deflection grips an inserted pole (e.g., umbrella pole) in the socket 10 tighter, providing for a stable base for the pole. In some cases, the side planes 26 of the tabs 24 may be parallel and/or in partial or full contact with each other when the insert 20 is fully screwed into the socket 10. This state may be the maximum inward deflection that the tabs 24 may be able to support, and the inner diameter of a circle formed by these fully inwardly deflected tabs 24 may be the smallest pole diameter that the overall apparatus may be able to support while still providing stability to the pole. In this state, there may be little or no space between the tabs 24, and thus may form a continuous or substantially continuous lower opening of the insert 20.

In some examples, tabs 24 may taper to a smaller cross-sectional area at their distal ends with intermediate spaces 2 between the distal ends of the tabs 24. When the tabs 24 are deflected inwards, the spaces 2 between tabs 24 are reduced or eliminated. When the tabs 24 are fully deflected, the tabs may form a substantially frustoconical shape.

Bottom tapered section 13 of the socket 10 may be tapered inward towards the closed end of the socket 10. This design may serve to reduce pole wobble by providing an additional wedged contact point at the bottom of the socket 10. By providing two radial contact points (e.g., tabs 24 and bottom tapered section 13), an inserted pole may be less likely to experience wobbling or rotation compared to when only a single radial contact point is implemented. In examples, the minimum inner diameter of the bottom tapered section 13 is substantially equal to a minimum diameter of the lower opening of the insert 20 formed by the fully deflected distal ends of the tabs 24 when the insert is fully screwed into the socket 10.

FIG. 5 shows that cap 30 is fitted in its uncapped position to allow for a pole to be placed in the apparatus. The cap 30 may be placed in the capped position when a pole is not present, protecting the internal components from external elements. Cap 30 generally rotates about receiving snapping elements 25, although alternative designs are contemplated. In this example, cap 30 may remain affixed to the insert 20 while staying open, and still provide enough space to place a pole to be inserted through opening 23 and into socket 10.

Figure 6:
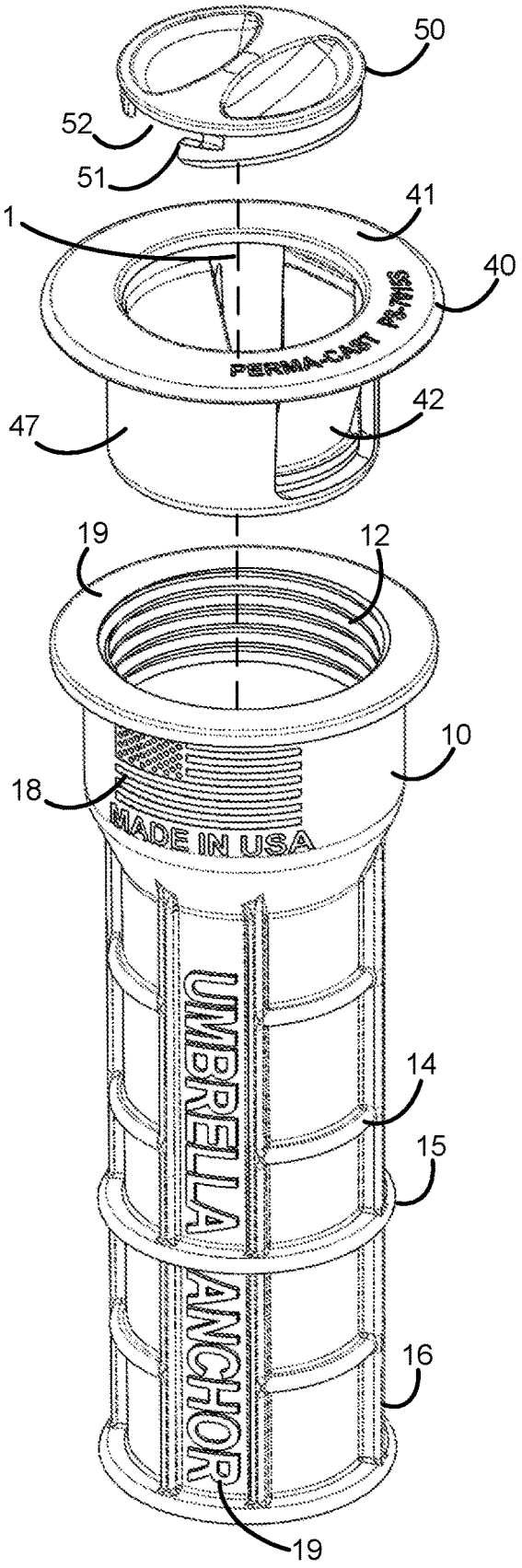
FIG. 6 is an exploded isometric view of an alternate embodiment of the pole holder apparatus.
Figure 7:
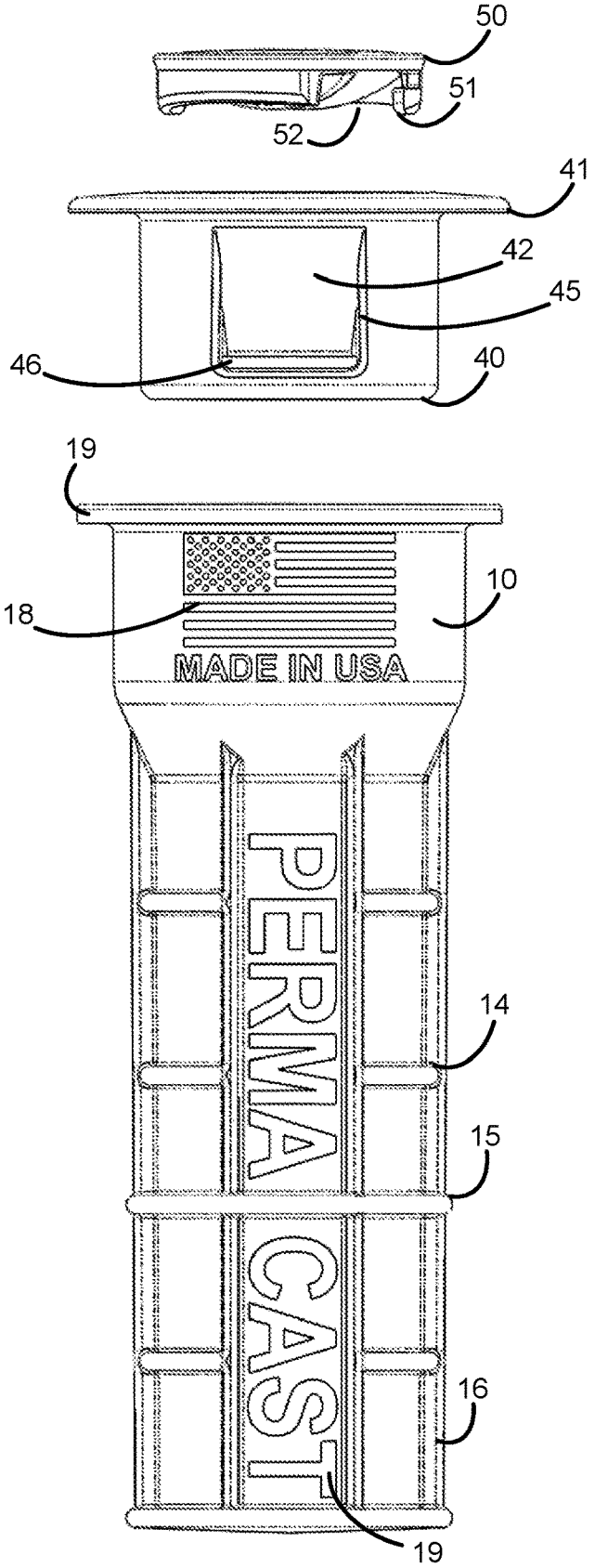
FIG. 7 is an exploded front view of the alternate embodiment of the pole holder apparatus.
Figure 8:
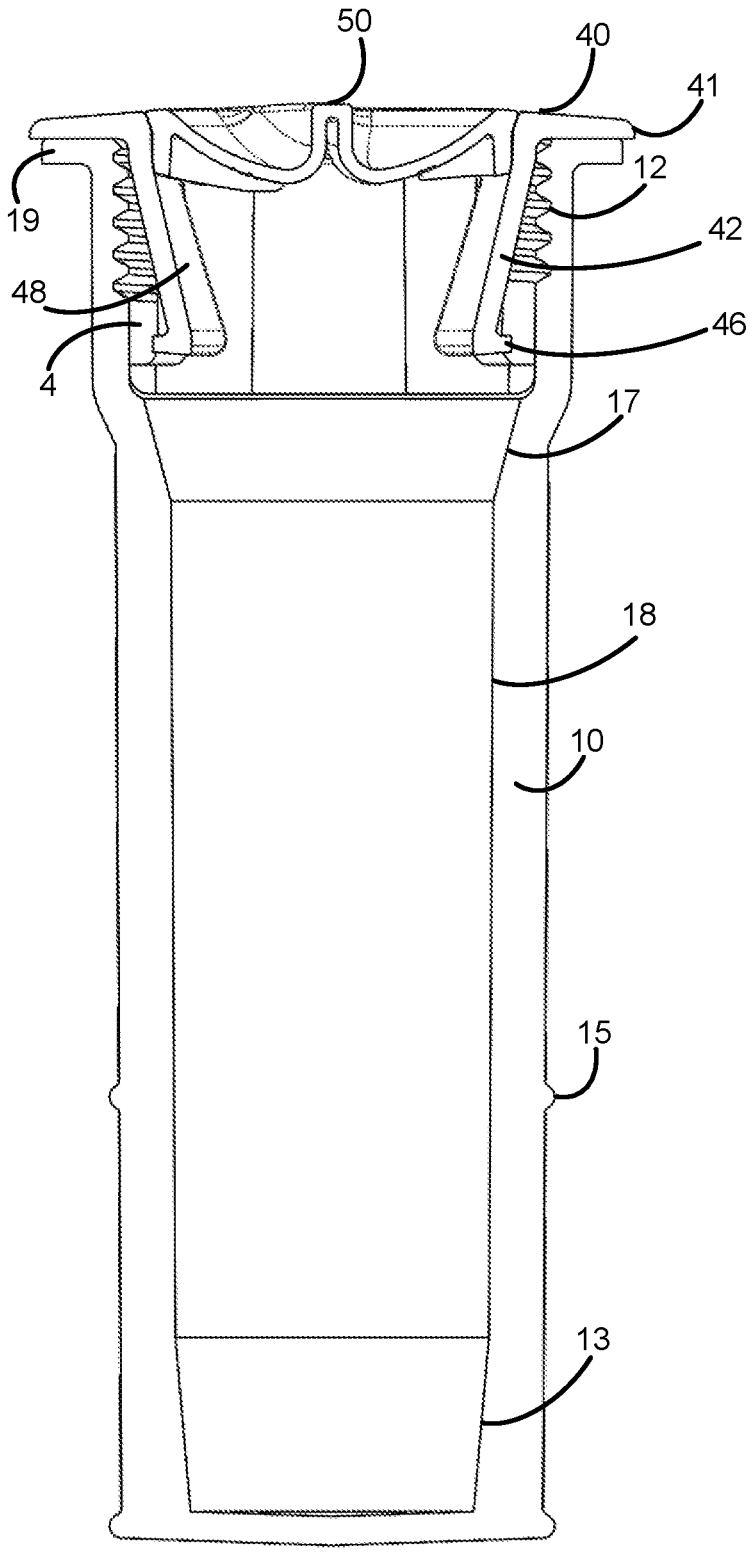
FIG. 8 is an assembly front section view of the alternate embodiment of the pole holder apparatus.
Figure 9:
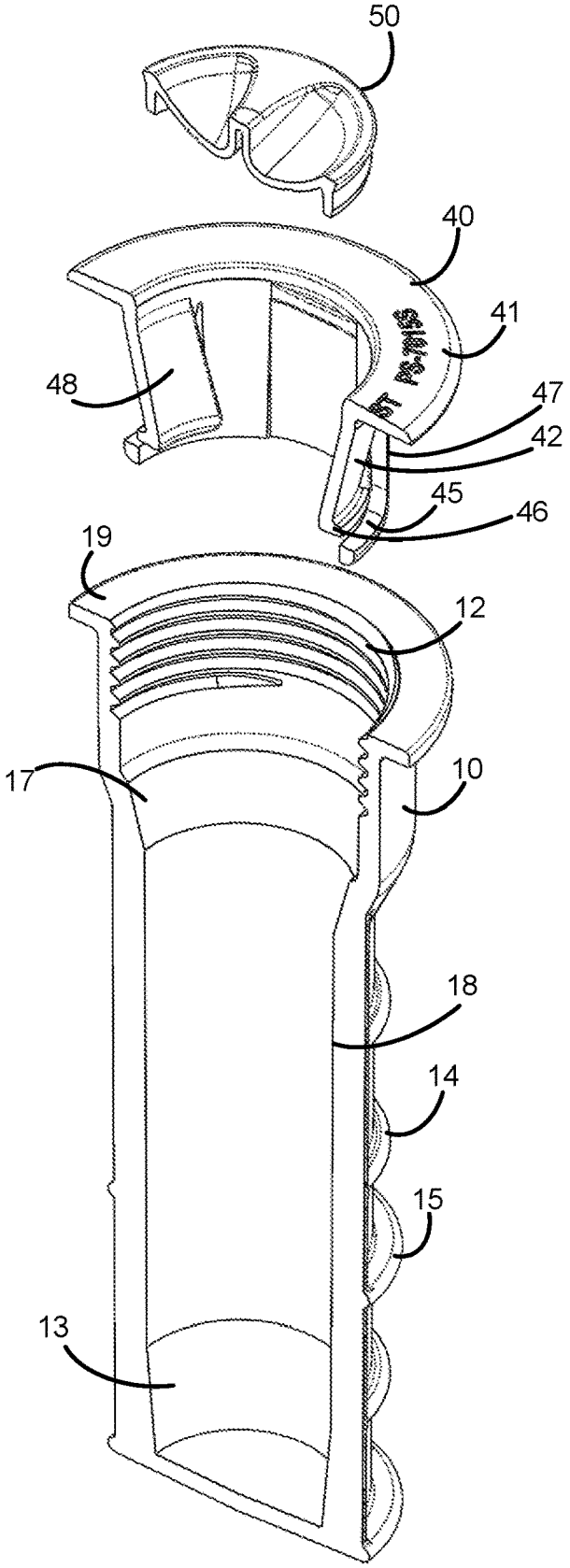
FIG. 9 is an exploded isometric section view of the alternate embodiment of the pole holder apparatus.

FIG. 6 is an exploded isometric view of an alternate embodiment of the pole holder apparatus. FIG. 7 is an exploded front view of an alternate embodiment of the pole holder apparatus. Previous descriptions of the same or similar features will not be repeated for brevity. FIG. 8 is an assembly front section view of the alternate embodiment of the pole holder apparatus. FIG. 9 is an exploded isometric section view of the alternate embodiment of the pole holder apparatus.

With concurrent reference to FIGS. 6-9, an alternative insert 40 is depicted. The insert 40 may generally be a friction fit insert designed to fit into the open end of socket 10. In some cases, insert 40 may be able to fit into other sockets (e.g., non-threaded sockets). Insert 40 may have a generally cylindrical shape, with upper flange 41 designed to fit over the top of socket 10 when fully inserted. Insert 40 may include a plurality of tabs 42 configured to grip an inserted pole. In some cases, insert 40 may friction fit into the top of the socket above the upper tapered section 17. A friction fit in this case may generally refer to a configuration where the outer wall 47 of insert 40 is designed to be adjacent to or flush with the inner diameter of threads 12. In cases where socket 10 does not include threads 12, outer wall 47 of insert 40 may be adjacent to or flush with an inner wall of socket 10 where threads 12 otherwise would be. Tabs 42 may be formed to inherently taper inwards towards the longitudinal axis 1 of the insert 40. In this way, tabs 42 may still be designed to provide pinching and/or holding functionality for inserted poles, though such tabs 42 may not interact with upper tapered section 17.

Cap 50 is shown at the top of the exploded view. This cap 50 may be designed to fit over the insert 40, providing protection against undesired elements when the assembly is not in use. The cap 50 may be designed to screw onto insert 40 using tab(s) 51 and opening 52.

Portions or all of the insert 40, and cap 50 may be made of any material or combinations of materials, such as metals, alloys, polymers (e.g., plastics), ceramics, glasses, composites, the like, or combinations thereof. Different parts of the insert 40, and cap 50 may be made of the same material or different materials.

FIG. 8 is an assembly front section view of an alternate embodiment of the pole holder apparatus. FIG. 9 is an exploded isometric section view of an alternate embodiment of the pole holder apparatus. Previous descriptions of the same or similar features will not be repeated for brevity.

As shown, the bottom of insert 40 may be just above tapering 17 when the insert 40 is fully inserted. Insert 40 may be configured as a snap-in or friction fit insert designed to be compatible with a wide variety of sockets 10, including sockets 10 that do or do not include internal threads 12, or that do or do not include upper tapered section 17. In cases where socket 10 does not include threads 12, outer wall 47 of insert 40 may be adjacent to or flush with an inner wall of socket 10 where threads 12 otherwise would be.

Insert 40 may include tabs 42 which may be formed to angle inwards without any applied contact. Insert 40 may include corresponding openings 45 for some or each of the tabs 42. Tabs 42 may deflect radially outwards when a pole is placed through the insert 40 and contacts inside surface 48 of tabs 42. For example, tabs 42 may deflect partially or completely through openings 45. In some examples, ends 46 of tabs 42 may deflect outwards and through openings 45 to contact an upper inside surface 4 of socket 10 to enhance the frictional fit of insert 40. For example, depending on the diameter of the inserted pole, the ends 46 may be deflected enough away from the longitudinal axis 1 that they contact, and are deformed against, the upper inside surface 4 of the socket 10. In such examples, when a pole is placed into the apparatus and causes the deflection of tabs 42 outward, the insert 40 frictionally grips socket 10, providing greater stability to the apparatus and pole. In other examples, the ends 46 may be deflected into the openings 45, but not enough to contact the upper inside surface 4 of the socket 10. In either event, tabs 42 may provide pinching and/or holding functionality for inserted poles. In some examples, when the pole is removed from the apparatus, ends 46 may contact and become lodged in threads 12, which may allow for the pole to be removed from the insert 40 while the insert is still inserted into the socket 10. In other examples, the deflection of the ends 46 by the inserted pole is not enough to cause the ends to contact the threads 12, so the pole can be removed with the insert still attached. In other examples, the frictional force of the contact between the insert 40 and socket 10 may be greater than the frictional force of the contact between the inserted pole and the tabs 42, so the pole may be removed without causing the insert 40 to be pulled out of the socket 10. In other examples, the insert 40 may be manually held down while pole is removed so that the insert 40 does not get pulled out of the socket 10 as the pole is removed.

Cap 50 may be configured to screw into insert 40 such that the top of cap 50 is flush with the top of insert 40. Cap 50 may be able to screw into insert 40 with just one rotation using tab 51 and opening 52. Alternative designs to cap 50 are possible and contemplated.

Figure 10:
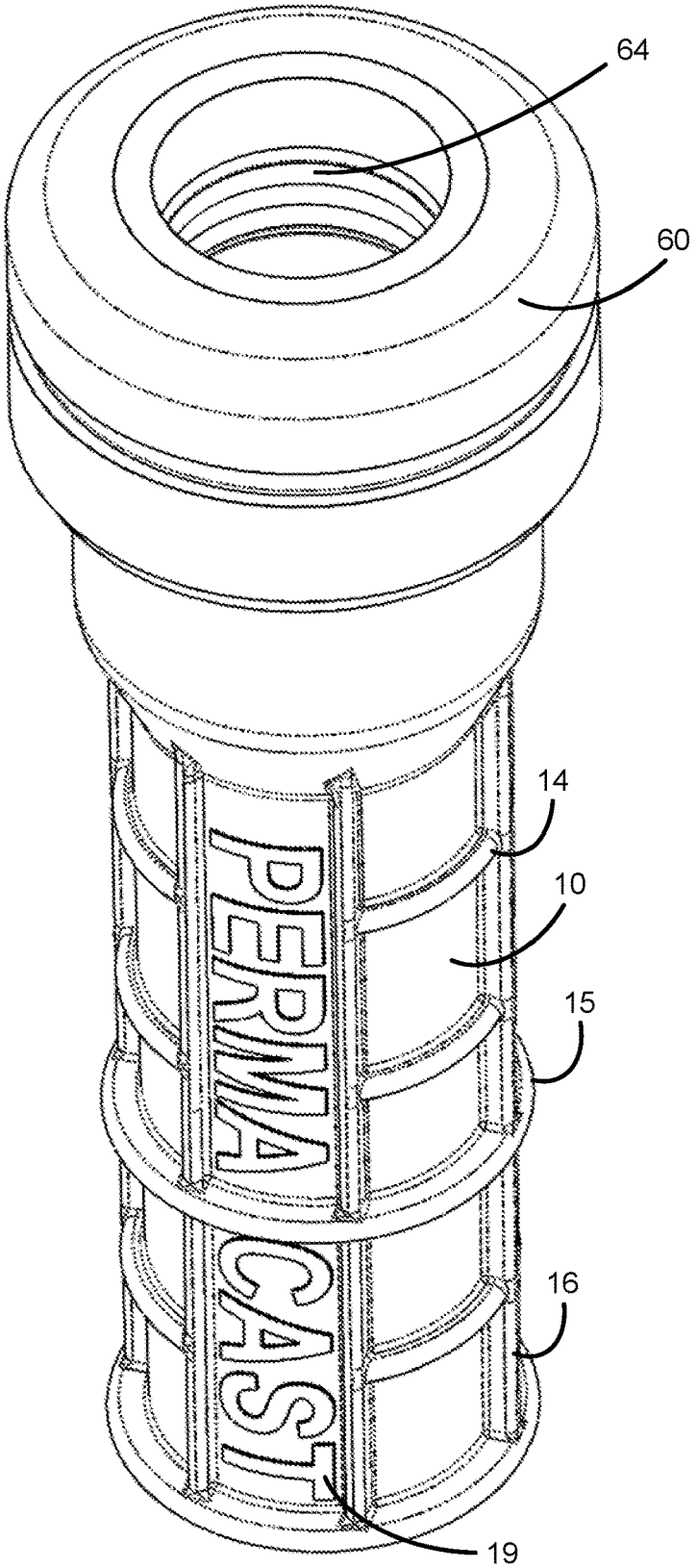
FIG. 10 is an assembly isometric view of another embodiment of the pole holder apparatus.

FIG. 10 is an assembly isometric view of another embodiment of the pole holder apparatus. Previous descriptions of the same or similar features will not be repeated for brevity.

Referring concurrently to FIGS. 10-14, the figures present an assembled configuration of the pole holder apparatus, which may include socket 10 and a newly designed insert 60 that attaches to the pole itself, and screws into the socket 10. In this way, the entire pole (e.g., and umbrella) may be rotated to screw the insert 60 into and out of the socket 10.

In this example, the insert 60 is threadingly engaged with the socket 10. The insert 60 may be substantially cylindrical. This engagement is facilitated by the external threads 62 of the insert 60 interacting with the internal threads 12 of the socket 10 (not shown). The insert's substantially cylindrical hollow section 64 may provide a receptacle for a pole.

The insert 60 may be made of any material or combinations of materials, such as metals, alloys, polymers (e.g., plastics), ceramics, rubber (such as ethylene propylene diene monomer (EPDM) glasses, composites, the like, or combinations thereof. Different parts of the insert 60 may be made of the same material or different materials.

Figure 11:
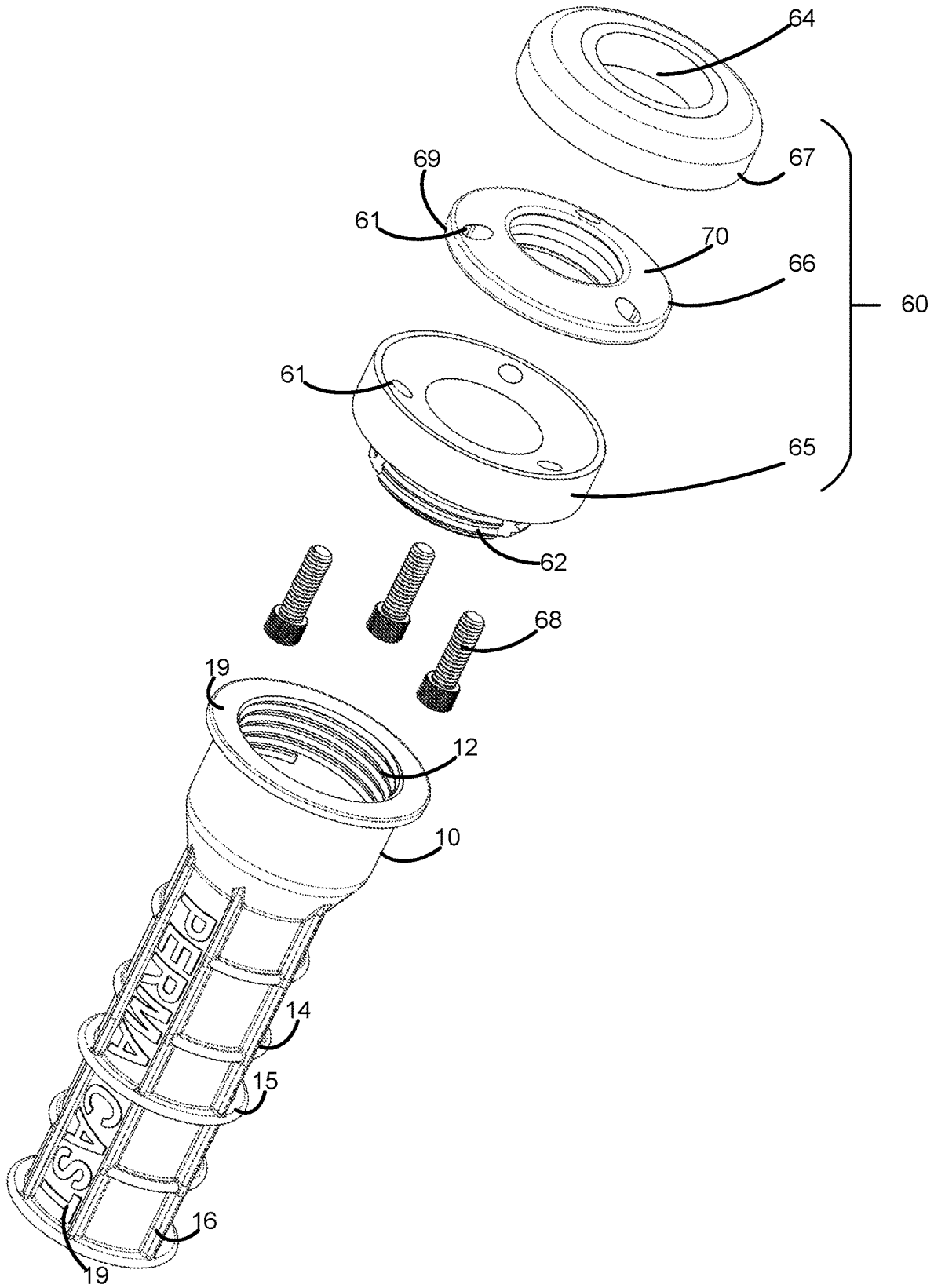
FIG. 11 is an exploded isometric view of the other embodiment of the pole holder apparatus.
Figure 12:
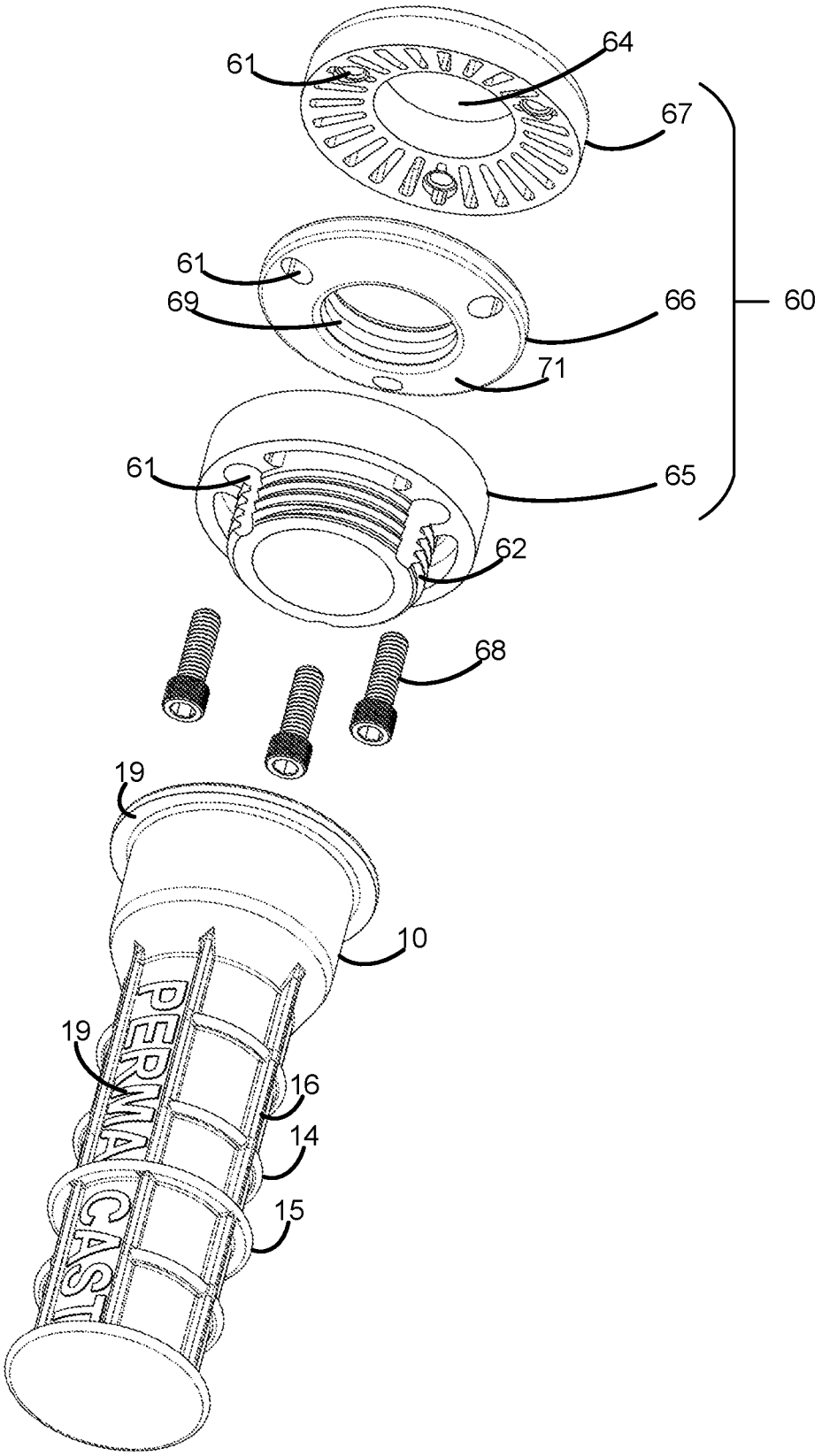
FIG. 12 is an exploded isometric view of the other embodiment of the pole holder apparatus, displayed from a different angle from FIG. 11.
Figure 13:
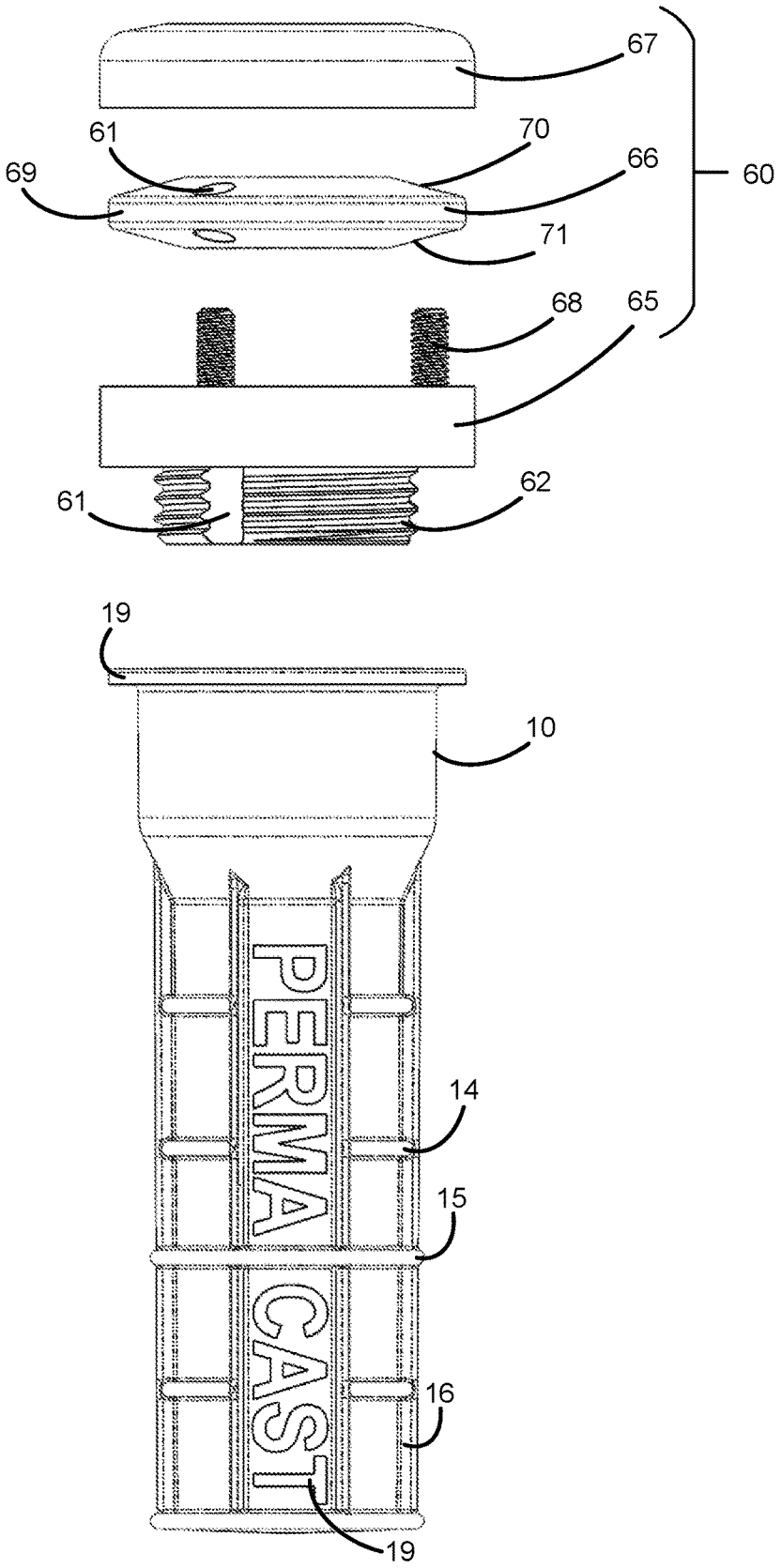
FIG. 13 is an exploded front view of the other embodiment of the pole holder apparatus.
Figure 14:
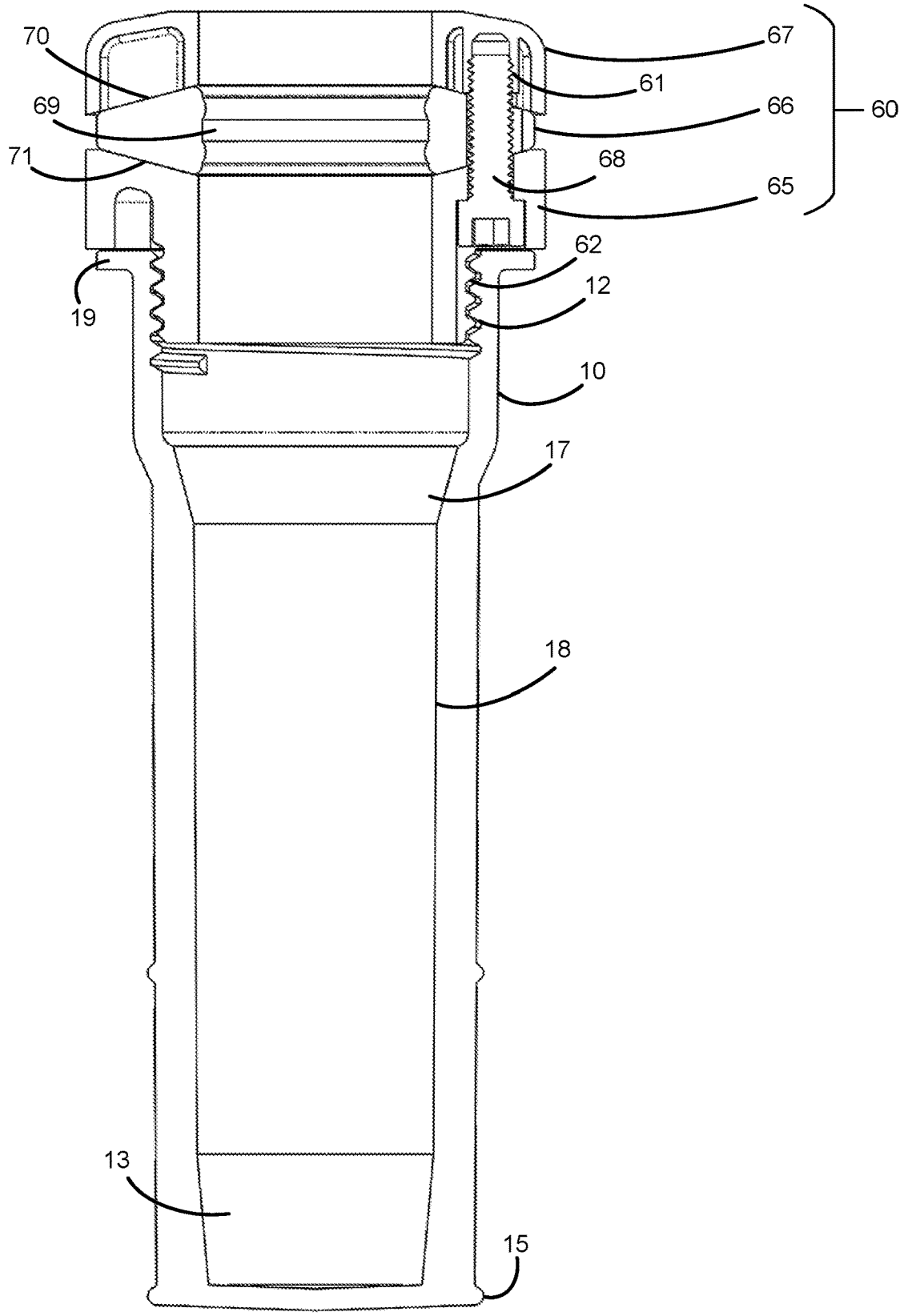
FIG. 14 is an assembly front section view of the other embodiment of the pole holder apparatus.

FIG. 11 is an exploded isometric view of the other embodiment of the pole holder apparatus presented in FIG. 10. FIG. 12 is another exploded isometric view of the other embodiment of the pole holder apparatus, displayed from a different angle from FIG. 11, to emphasize the underside of the components of the insert. FIG. 13 is an exploded front view of the other embodiment of the pole holder apparatus. Previous descriptions of the same or similar features will not be repeated for brevity. FIG. 14 is an assembly front section view of the alternate embodiment of the pole holder apparatus. Previous descriptions of the same or similar features will not be repeated for brevity.

Referring concurrently to FIGS. 10-14, the insert 60 is shown in an exploded format, comprising at least three parts 65, 66, and 67. Insert 60 may include part 65, part 66, part 67, screws 68, or combinations thereof. Part 65 may include external threads 62 designed to mate with the internal threads 12 of the socket 10. Part 66 may mate with part 65 via one or more screws 68. Each part 65, 66, and 67 may include screw holes 61 for the screws 68. One, two, or all three parts may include threading to mate with screws 68. Part 67 may mate with part 66 via screws 68. Together, parts 65, 66, and 67 may be engaged with one another via screws 68, and the collective assembly of insert 60 may be able to be attached to a pole. Although three screws 68 are depicted to connect parts 65, 66, and 67, those of skill in the art will appreciate that a different fastener (or a different number of one or more screws 68) may be used. Insert 60 may be screwed into socket 10 by rotating the pole itself. In some examples, all or portions of insert 60 may be made of rubber. For example, inside portion 69 of part 66 may be made of rubber to stay fixed to a pole. In some other examples, part 66 may be made entirely or mostly of rubber.

Part 66 may include sloped top and bottom surfaces 70 and 71. By tightening screws 68, part 66 may be compressed to engage or grip a pole that may be inserted. For example, part 66 may be made of a deformable rubber (such as EPDM) that, when compressed by tightening screws 68, causes the inner diameter of part 66 to decrease, thereby gripping an inserted pole. The sloped surfaces may provide radial forces directed towards the center of the part 66 upon tightening the screws 68. These radial forces may push the rubber inwards, putting pressure on the inserted pole, and gripping the pole. Parts 65 and 67 may include sloped surfaces designed to mate with the sloped surfaces 70 and 71 of part 66. Poles of different diameters may be accommodated by changing the amount the screws 68 are tightened. Once the insert 60 is tightened around a pole at an appropriate distance from the end of the pole to accommodate the depth of socket 10, the insert 60 (and the then attached pole) may be inserted into the socket 10 by threadingly engaging the socket 10 with the threads 62 of the insert 60. This embodiment provides a strong grip on the pole, reducing wobbling of a pole in the socket 10.

The internal threads 12 of the socket are visible and may engage with the corresponding external threads 62 of the insert 60. The insert 60 is displayed in an assembled state, screwed into the socket 10. The parts 65, 66, and 67 of the insert 60 are evident in this sectional view. Screws 68 may extend through the three parts 65, 66, and 67. The sloped top and bottom surfaces 70 and 71 are also evident. Pressure exerted from the compression of parts 65 and 67 on part 66 via the screws 68 may force at least a portion of the part 66 (e.g., inside portion 69) inwards to compress onto an inserted pole. This compression may be more easily facilitated when all or part of part 66 is made from a compressible material such as rubber. For example, inside portions 69 of insert 66 may be made of rubber.

As described previously, insert 60 may be attached to a pole prior to and/or after insertion into socket 10. Insert 60 may be screwed into socket 10. In this way, the entire pole (e.g., and umbrella) may be rotated to screw, or unscrew, the insert 60 from the socket 10. The insert 60 may be attached to the pole at a particular height so that the bottom of the pole creates a wedged contact in the lower tapered section 13 of the inner surface of socket 10 once the insert 60 is screwed into the socket 10.

It is to be understood that any number of the features of the different examples described herein may be combined into one single example and alternate examples having fewer than or more than all of the features herein described are possible. For example, any other pole or similar apparatus may be supported by the holding apparatus described herein. Use is not limited to only an umbrella pole. The socket apparatus of the present disclosure may be placed into any surface or material, such as the ground (e.g., concrete, dirt), cement, asphalt, sand, wood, stone, metal, polymers, ceramic, or the like.

While there have been described herein what are to be considered exemplary and preferred examples of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A pole socket, comprising:

a socket body comprising internal threading, comprising an open end and a closed end, wherein an inner wall of the socket body comprises an upper tapered section proximate to the open end of the socket body, and wherein the upper tapered section narrows in diameter towards the closed end of the socket body and is defined by an angled surface that extends continuously from an upper internal surface of the socket body to a lower internal surface of the socket body, and wherein the upper tapered section is angled with respect to the upper internal surface and the lower internal surface;

an insert comprising external threading, comprising an upper opening and a lower opening, configured to be secured to the socket body proximate to the open end of the socket body, and wherein the insert is configured to be screwed into the socket body through the engagement of the external threading with the internal threading; and a cap, configured to be attached to the insert and remain attached to the insert in an open position, where the cap uncovers the upper opening, and in a closed position, where the cap covers the upper opening.

2. The pole socket of claim 1, wherein the inner wall of the socket body comprises a lower tapered section proximate to the closed end of the socket body.

3. The pole socket of claim 1, wherein the insert further comprises a plurality of tabs proximate to the lower opening of the insert.

4. The pole socket of claim 3, wherein the plurality of tabs expand when the insert is unscrewed from the socket body.

5. The pole socket of claim 1, wherein the insert is discontinuous proximate to the lower opening of the insert.

6. The pole socket of claim 1, wherein the insert further comprises a plurality of tabs proximate to the lower opening of the insert, and wherein the plurality of tabs are configured to deflect inwards when the insert is screwed into the socket body and when the plurality of tabs contact the upper tapered section.

7. The pole socket of claim 1, wherein the open end of the socket body, the upper opening of the insert, and the lower opening of the insert are configured to receive an umbrella pole.

8. The pole socket of claim 1, wherein the insert is configured to friction fit into the socket body.

9. The pole socket of claim 1, wherein the insert further comprises a plurality of tabs angled inwards.

10. The pole socket of claim 1, wherein the insert further comprises a plurality of openings corresponding to the plurality of tabs, wherein when a pole is placed in the insert, the plurality of tabs deflect outwards and at least partially through the plurality of openings.

11. A pole socket, comprising:

a socket body comprising internal threading, comprising an open end and a closed end, wherein an inner wall of the socket body comprises an upper tapered section proximate to the open end of the socket body, and wherein the upper tapered section narrows in diameter towards the closed end of the socket body and is defined by an angled surface that extends continuously from an upper internal surface of the socket body to a lower internal surface of the socket body, and wherein the upper tapered section is angled with respect to the upper internal surface and the lower internal surface;

an insert comprising external threading and a plurality of tabs, wherein the insert is configured to be screwed into the socket body through the engagement of the external threading with the internal threading, and wherein the plurality of tabs are configured to deflect inwards as the insert is screwed into the socket body; and a cap that is configured to cover an upper opening in the insert.

12. The pole socket of claim 11, wherein the inner wall of the socket body comprises a lower tapered section proximate to a closed end of the socket body.

13. The pole socket of claim 11, wherein the plurality of tabs expand when the insert is unscrewed from the socket body.

14. The pole socket of claim 11, wherein the insert is discontinuous proximate to a lower opening of the insert.

15. A pole socket, comprising:

a socket body comprising internal threading and comprising an open end and a closed end, wherein an inner wall of the socket body comprises an upper tapered section proximate to the open end of the socket body, and wherein the upper tapered section narrows in diameter towards the closed end of the socket body and is defined by an angled surface that extends continuously from an upper internal surface of the socket body to a lower internal surface of the socket body, and wherein the upper tapered section is angled with respect to the upper internal surface and the lower internal surface;

an insert comprising external threading and a plurality of tabs, wherein the insert is configured to be screwed into the socket body through the engagement of the external threading with the internal threading, and wherein the plurality of tabs are configured to deflect inwards as the insert is screwed into the socket body; and a cap, configured to be attached to the insert and remain attached to the insert in an open position, where the cap uncovers an upper opening of the insert, and in a closed position, where the cap covers the upper opening.

16. The pole socket of claim 15, wherein the inner wall of the socket body comprises a lower tapered section proximate to the closed end of the socket body.

17. The pole socket of claim 15, wherein the plurality of tabs expand when the insert is unscrewed from the socket body.

18. The pole socket of claim 15, wherein the insert is discontinuous proximate to a lower opening of the insert.

* * * * *